US008042615B1

(12) United States Patent
Wattenburg

(10) Patent No.: US 8,042,615 B1
(45) Date of Patent: Oct. 25, 2011

(54) BLOW OUT PROTECTOR VALVE EMPLOYING BALL BAFFLE ASSEMBLY FOR USE WITH HIGH-PRESSURE FLUIDS

(76) Inventor: Willard Harvey Wattenburg, Walnut Creek, CA (US)

( * ) Notice: Subject to any disclaimer, the term of this patent is extended or adjusted under 35 U.S.C. 154(b) by 0 days.

(21) Appl. No.: 12/878,912

(22) Filed: Sep. 9, 2010

(51) Int. Cl.
*E21B 33/13* (2006.01)

(52) U.S. Cl. ..... 166/373; 166/85.4; 166/75.15

(58) Field of Classification Search ..... 166/373, 166/85.4, 75.15, 84.3, 318
See application file for complete search history.

(56) References Cited

U.S. PATENT DOCUMENTS

| | | | | |
|---|---|---|---|---|
| 1,569,247 | A | 1/1926 | Abercrombie et al. | |
| 3,926,256 | A * | 12/1975 | McCall | 166/285 |
| 4,369,845 | A * | 1/1983 | Henson et al. | 166/298 |
| 4,420,040 | A * | 12/1983 | Arbasak et al. | 166/70 |
| 7,357,181 | B2 * | 4/2008 | Webb et al. | 166/285 |
| 7,571,773 | B1 * | 8/2009 | West et al. | 166/373 |

* cited by examiner

*Primary Examiner* — William P Neuder
(74) *Attorney, Agent, or Firm* — David Pressman

(57) ABSTRACT

A Ball Baffle Blowout Preventer (BBBOP) (102) or shut-off valve generally comprises a housing (106) and a baffle (108) secured within the housing and containing a plurality of holes. The housing is mounted in the path of the well pipe but the holes in the baffle allow normal production fluid to pass. One or more ball dispensing mechanisms (BDM) (110, 112) are connected to the housing. Each BDM contains a plurality of balls (114) and one or more valves (196). When a blowout condition occurs, a plurality of balls (114) are released beneath baffle (108) and are carried upward by the upwardly gushing fluid to plug the holes. The balls (114) are held in place by the pressure differential below and above the baffle. The balls can be removed from the baffle by the forcing fluid down the well. All operations can be controlled undersea by remotely operated vehicles (ROVs). A plurality of BBBOPs can be stacked and each can be set to operate at a different pressure and flow rates. The BBBOP may also include a Threshold Pressure Detection Unit for actuating the BDM that requires no electro-mechanical components; it uses only the energy of pressurized fluids in a well bore. The manual and self-actuating BDMs are not disabled by slow leaks of ambient well pressures past the hydraulic seals used therein. In another embodiment an additional baffle (250) can be provided below the first baffle (108) to contain the balls after they are released from the first baffle.

21 Claims, 6 Drawing Sheets

BLOW OUT PROTECTOR VALVE EMPLOYING BALL BAFFLE ASSEMBLY FOR USE WITH HIGH-PRESSURE FLUIDS

BACKGROUND

Prior Art—Blowout Preventers

Sources and deposits of oil and gas are found below land and below the floor of the oceans and other bodies of water (hereinafter seas). Such deposits are often highly pressurized due to their depth. When oil companies drill wells at great depth, they must take care to contain these highly pressurized sources at all times so that they do not gush up and "blowout" of the well at the well head, where the well pipe reaches the surface. Special equipment called "Blowout Preventers" (BOPs) are normally installed at well heads to stop the uncontrolled flow of oil and/or gas.

When there is a sudden uncontrollable increase of pressure in a well, called a "kick," standard BOPs in use today are designed to cut and seal off, crush, and/or otherwise seal a well casing so that the oil and/or gas cannot escape rapidly (blowout or gush). Such blowouts are particularly dangerous and harmful when they occur deep underwater, as happened in 2010 in the Gulf of Mexico. The 2010 Gulf Oil Spill demonstrated how difficult and expensive it is to stop the oil and gas gushing from a well deep under water when existing BOPs fail to operate properly. In addition, such gushers cause great ecological and economic damage and can cause loss of human, as well as animal, life.

There are three major components of a BOP system: a Blow-Out Detector, a Flow Stoppage Valve, and an Actuator.

- A Blowout Protector (BOP) is a robust and reliable valve mechanism that can stop the flow of oil or gas in a well.
- A Blowout Detector is a device(s) that measures pressures in a well bore and other conditions, such as fluid leakage, that indicate an impending blow-out condition.
- A BOP Actuator is a device that actuates a BOP when dangerous well pressures are detected.

The BOP is essentially a large shut-off valve in line with a well casing that is used in emergencies to stop an uncontrollable upward flow of high-pressure oil or gas. During drilling of the well, the BOP is normally open in the axial direction to permit insertion of drill pipes and drilling tools down the well casing. When the well is producing oil or gas, there is usually no drill pipe inside the BOP and the well casing above the BOP (the riser pipe) that is delivering the product. BOPs are typically affixed on top of a well casing at or slightly above ground or at sea floor level. For redundancy and reliability, two or more independent BOP units are usually mounted one on top of the other in a massive cast steel structure called a BOP stack. The typical BOP stack looks like a stack of enormous steel donuts. The stack can weigh several hundred tons and tower 50 feet or more in height. A typical BOP stack must have such great weight to counter the upward hydraulic force of the greatest fluid pressures that can occur in a well; such upward force can push a BOP stack off of the well casing if the stack does not weigh more than the upward hydraulic force.

Standard BOP valves require large hydraulic and mechanical forces to cut and seal off, crush, or otherwise seal a well pipe. The actuating forces are supplied by conduits from remote locations (like the sea surface) or by backup energy sources stored in or near the BOP stack.

Well bore pressures are measured and blow out conditions are detected by a variety of Blow-Out Detectors, which often are electro-mechanical devices that require external power.

BOPs are generally actuated by remote operators using control conduits connected to the BOP stack. For example, when blowout conditions are detected the remote operator sends a signal via the conduit to the BOP stack; the signal actuates one or more BOPs in the stack, causing a blockage in the well bore to prevent oil or gas flow up through the stack. Some control equipment can actuate BOPs automatically when blowout conditions are detected.

One standard BOP in use today is called an annular BOP. An annular BOP uses an elastomeric toroidal seal (usually made of rubber), called a packing unit. The packing unit is reinforced with steel ribs. Its outer circumference is restrained within the BOP housing. The inner diameter is sufficient to allow the passage of drill pipe and the joints which attach one piece of drill pipe to the next. In its inactivated state, the BOP allows rotation and vertical motion of the drill pipe. When the BOP is activated, the toroidal seal is squeezed from above and below in an axial direction by an activating mechanism. This squeezing (a) causes the inner diameter of the seal to decrease until it contacts the drill pipe, and (b) forces the outer circumference of the seal against the inside wall of the BOP housing, thus forming a tight seal around the drill pipe. If gas continues to flow up the drill pipe, mud can be forced down the drill pipe at sufficient pressure to stop this flow. At this point, drilling can resume. If no drill pipe is present, the annular BOP should still be able to completely close the well casing orifice. Knox, in U.S. Pat. No. 2,609,836 (1952), shows an annular BOP.

The other principal type of BOP is called a ram-type BOP since it uses one or more rams as explained in the next paragraph. An early one of these is taught by Abercrombie and Cameron in U.S. Pat. No. 1,569,247 (1926).

Four principal types of BOPs are in use today: pipe, blind, shear, and blind shear. All of these comprise pairs of radially disposed, opposing jaws with either seals or shears that are normally retracted and out of the way during drilling. Powerful hydraulic rams force seals or shears to move radially inwardly toward the center of the well casing or outward away from the center of the casing; the rams are supplied with actuating force, usually in response to a control signal from a remote location. The following is a brief discussion of these four principal types:

Pipe Ram BOP—When activated, the pipe ram BOP is designed to squeeze around the drill pipe and also to block the annulus between the drill pipe and the well casing. Elastomeric seals are used in conjunction with the squeezing mechanism to prevent leaks in these areas.

Blind Ram BOP—This type is similar to the pipe ram BOP, except that it seals the well casing when there is no drill pipe present.

Shear Ram BOP—This type is used to cut through and block the drill string or the well casing. A pair of shears cut through the pipe, followed by a pair of blind ram jaws that close on one-another, pinching the pipe shut and closing the annulus to any flow. Standard Shear Ram BOPs are destructive. They damage the drill pipe and/or the well casing within the BOP Stack in order to stop the flow of oil and gas through the BOP Stack. These pipes must be replaced in the BOP stack before normal well operations can continue.

Blind Shear Ram BOP—This type cuts through the drill pipe and blocks the annulus between the drill pipe and the casing, thereby sealing the well shut.

The above prior-art BOP mechanisms require great mechanical or hydraulic actuating forces. These forces must be supplied by force generating equipment within the BOP stack or by external means. Today, undersea wells are tended by Remotely Operated Vehicles (ROVs). In the case of these wells, an ROV cannot provide the forces necessary to operate the BOPs when their force generating equipment fails. The 2010 Gulf Oil Spill demonstrated the great difficulty and enormous expense required to repair and/or actuate conventional BOPs after they fail to operate properly, especially when the well head is deep underwater.

From my review of major oil spills, in particular the 2010 Gulf Oil Spill, I believe that existing BOP systems suffer from one or more of the following deficiencies or disadvantages:

1. The BOP may require a separate or a remote electromechanical apparatus to detect dangerous pressures (kicks or blowouts) in the well casing to which it is attached.
2. The BOP may require great mechanical or hydraulic forces to actuate its oil and gas flow stoppage valve mechanism.
3. The BOP may need a backup power supply, such as batteries, so that it can actuate automatically when well pressures reach dangerous levels.
4. The BOP may not be actuable manually by remote control lines or ROVs operating at great depths underwater.
5. The BOP may damage the well casing or drill pipe when it is actuated.
6. The BOP, once closed or in an obturating condition, may not be openable or reversible very easily to resume all other well operations.
7. The BOP may be too expensive to be added to thousands of existing BOP Stacks on producing oil and/or gas wells to provide additional measures of safety.
8. The BOP may be complex and not fail-safe, preventing it from being employed long-term and unattended on thousands of "capped" wells from which expensive BOP Stacks have been removed.

While all of the above disadvantages are significant, I presently believe that disadvantage 7—the high cost of BOPs—is one of the paramount concerns. The deep underwater oil and gas exploration business is in jeopardy until an economical and reliable BOP becomes available. The 2010 Gulf Oil Spill has demonstrated the need for additional blowout protection on existing underwater oil wells with supplemental BOPs that can be actuated, adjusted, and repaired by ROVs working deep underwater.

I also believe that disadvantage 8—complexity and lack of fail-safe operation—is also highly important. There are no safeguards on thousands of supposedly "capped" wells that will eventually leak into the environment when their concrete plugs and even their steel well casings deteriorate.

SUMMARY

In one embodiment, my BOP comprises a foraminous plate or baffle that is positioned in the well pipe or a container or housing in series with the well pipe. The plate has an array of holes of a predetermined diameter. Adjacent and below the container or portion of the pipe containing this plate is a source of obturating balls that have diameters slightly greater than the holes in the plate. When a blow-out condition occurs, the balls are released under the plate so that the upward flow of fluid in the well pipe forces the balls upward against the plate where they lodge in the holes and thus cause the plate to block further fluid flow and prevent any blow-out.

ADVANTAGES OF VARIOUS ASPECTS AND EMBODIMENTS

I have developed improved BOP systems for use in the drilling and management of oil wells that, in one or more aspects, resolves to a significant extent, one or more of the above-listed deficiencies or disadvantages with standard BOPs in use today. In one or more embodiments, my BOP:

a. is self-actuated when well pressures exceed specified limits that indicate a possible blowout; also the well-pressure threshold that triggers this BOP can easily be adjusted by remote control;
b. can seal a well in a non-destructive manner, i.e., without causing damage to the well casings or riser pipe;
c. can be opened after sealing (reversed) to allow normal well operation by simply pumping high pressure mud fluid down the well pipe above the BOP. This is the normal and usual "top kill" procedure whereby pressurized mud fluid is pumped into a well casing through a "mud port" in the BOP Stack to counteract the pressures in a well (controlling the well) after a BOP has been activated to stop a blowout. However no other expensive well structure repair or re-work actions are necessary to return the well to normal operation;
d. embodies a unique and robust pressure detection apparatus (BDM 112 in FIG. 1) that requires no electromechanical components. Its only power source comes from the fluid pressure in a well casing. This purely mechanical Pressure Detection Unit (PDU) can reliably operate for long periods of time in a hostile oil well environment. It is very inexpensive. In addition to actuating a BOP, this autonomous PDU can provide pressure threshold signals for any other purpose in oil well operations.
e. can be added easily and inexpensively to the ram-type BOP stacks on top of existing or future oil wells as an added measure of safety that the oil industry and government regulatory agencies desire for underwater wells. My BOP can be actuated quickly and reliably by light-weight ROVs operating in deep water to stop the flow of oil and/or gas when other BOPs fail, as happened in the 2010 Gulf Oil Spill.
f. can be applied in its simplest and least expensive form to thousands of "capped" and abandoned oil and gas wells throughout the world that now rely only on concrete plugs in well casings to prevent oil and/or gas leakage into the environment. Expensive BOP Stacks have been removed from most of these capped wells. The concrete plugs in these wells and the steel well casings themselves will deteriorate with time. These "capped" wells will begin to leak unless there are flow stoppage devices such as my BOP on the well casings at the well heads.

The mechanisms disclosed can also function as valves for high-pressure conduits, which valves have certain advantages.

Further advantages of various aspects will be apparent from a consideration of the ensuing description and accompanying drawings.

DRAWING FIGURES

DRAWING FIGURE REFERENCE NUMERALS

| | | | |
|---|---|---|---|
| 100 | Casing | 102 | BBBOP |
| 104 | Fluids | 106 | Housing |
| 108 | Baffle | 110 | Ball Dispensing Mechanism |
| 112 | Ball Dispensing Mechanism | 114 | Ball |
| 116 | Hole | 118 | Tube |
| 120 | Door | 122 | Plunger |
| 124 | Shaft | 126 | Piston |
| 128 | Seal | 130 | Seal |
| 132 | Support | 134 | Spring |
| 134A | Chamber | 134B | Port |
| 134C | Valve | 136 | Cap |
| 138 | Orifice | 140 | Chamber |
| 141 | Valve | 142 | Conduit |
| 143 | Port | 144 | Conduit |
| 146 | Tubular section | 148 | Tubular section |
| 150 | Chamber | 151 | Chamber |
| 152 | Spring | 154 | Piston |
| 156 | Shaft | 158 | Piston |
| 160 | Seal | 162 | Seal |
| 164 | Joint | 166 | Joint |
| 168 | Door | 170 | Valve |
| 172 | Vent conduit | 174 | Inlet |
| 176 | Valve | 180 | Outlet |
| 182 | Stopper | 184 | Spring |
| 186 | Plate | 188 | Screw |
| 190 | Orifice | 192 | Outlet |
| 194 | Cap | 196 | Valve |
| 198 | Handle | 200 | Tank |
| 205 | Valve | 210 | Regulating valve |
| 215 | Gauge | 220 | Gauge |
| 225 | Port | 230 | Valve |
| 250 | Baffle | 255 | Slots |
| 300 | Conduit | 305 | Mud |
| 500 | Valve | 505 | Actuator |
| 600 | Wedge | 605 | Wedge |
| 610 | Pipe | 615 | Tool |
| 620 | Hole | | |
| 625 | Hole | 700 | Port |
| 705 | Port | 710 | Seal |
| 715 | Bumper | 720 | Recess |
| 725 | Ring | 730 | Recess |
| 735 | Ring | 740 | Plug |
| 745 | Plug | 750 | Bolt |
| 900 | Core | 905 | Shell |
| 910 | Surface | | |

Abbreviations

| | | | |
|---|---|---|---|
| BBBOP | Ball Baffle BOP | BDM | Ball Dispensing Mechanisms |
| BOP | blow-out preventer | ROV | remotely operated vehicle |

DETAILED DESCRIPTION

Figure 1:
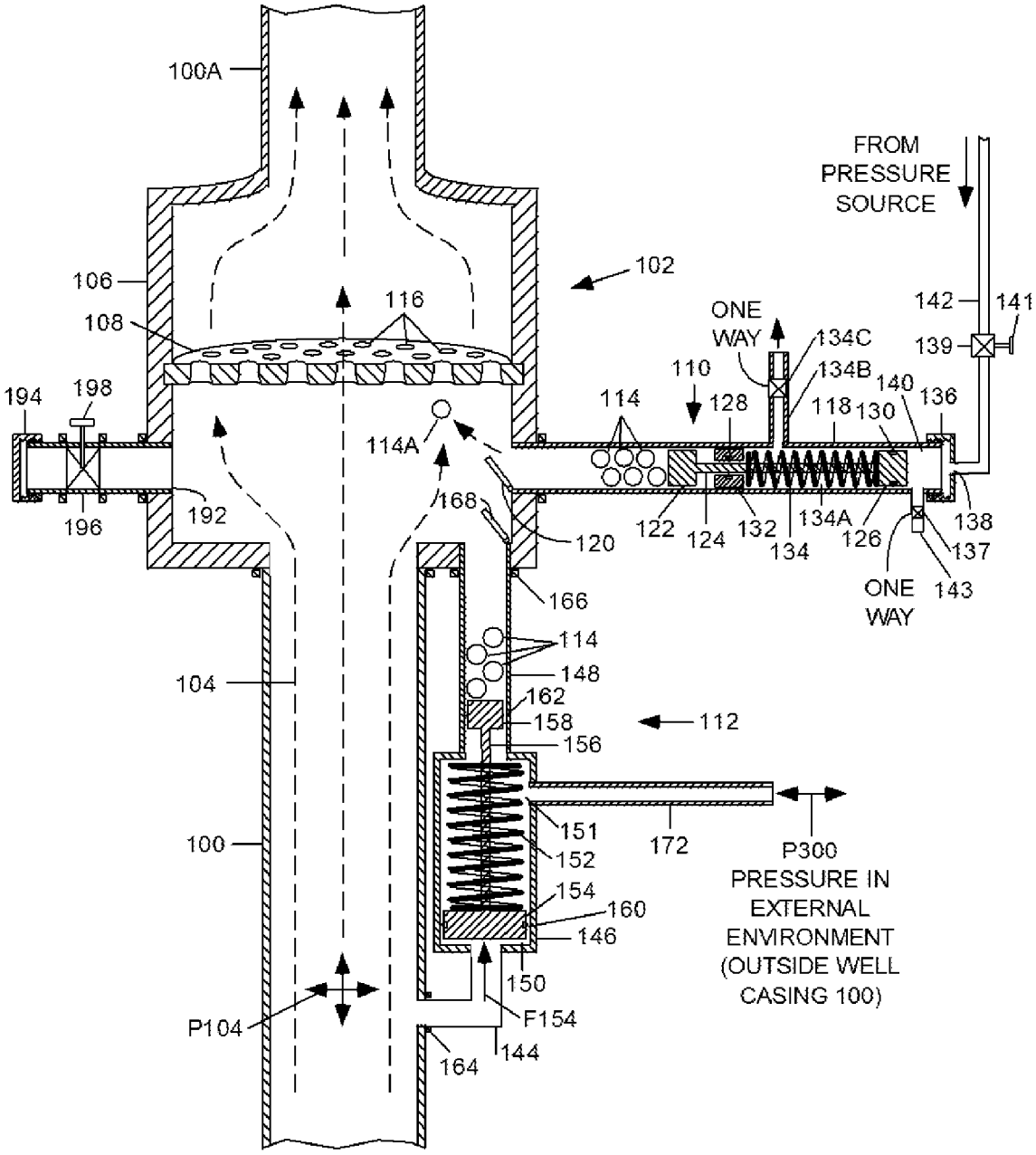
FIG. 1 shows a blowout preventer according to one aspect of a first embodiment.

FIG. 1—First Embodiment—Overview

My apparatus uses a foraminous plate or baffle in conjunction with a plurality of balls to block the unwanted flow of fluids from a well. To distinguish my apparatus from prior-art BOPs, I call it a Ball Baffle Blowout Preventer (BBBOP). The baffle or plate of my BBBOP is positioned in a housing that is inserted into any BOP stack, oil well riser pipe, or well casing. The baffle is a thick metal disc or plate (much like a thick steel manhole cover) that has an array of holes drilled through it so that liquid and gas can pass through it without great restriction. To stop the flow of all fluids and gas through the baffle, its holes become tightly plugged by the release of solid balls into the oil or gas flow entering the baffle. The fluid flow forces the balls lodge firmly in respective holes in the baffle to stop the flow of oil and/or gas.

I also provide simple but very reliable Ball Dispensing Mechanisms (BDMs) that require very little energy or force to actuate. One BDM embodiment is fail-safe. It is self-actuating by well pressures that indicate blowout conditions in the oil well. It requires only energy supplied by the pressurized oil or gas in the well casing to which it is attached. The threshold pressures for automatic activation can be adjusted before installation or later by an ROV operating underwater. Another BDM can be actuated manually by control conduits to a distant control center or by an ROV that injects a small amount of pressurized fluid into a port on the BOP (like a grease gun operation). This operation is easily preformed by an ROV operating at great depths under water. Neither of these BDMs utilizes electro-mechanical components. Both of these BDMs will operate properly over long periods of time in the hostile oil well environment, even when their hydraulic seals are leaking slowly.

The flow stoppage performed by this Ball Baffle BOP (BBBOP) can be reversed by simply pumping mud fluid into the well pipe above the BBBOP and reversing the flow through the BBBOP to release the balls from the baffle and sweep the balls from the BBBOP housing. My BBBOP is very unlikely to destroy or damage the well pipe in which it is installed. Operating or actuating my BBBOP does not require large mechanical or hydraulic forces and/or sophisticated control systems, as is the case for the shear rams and other devices in the BOPs commonly used in the oil well industry today. This relatively inexpensive BBBOP is easily added to existing BOP stacks at the well head or it can be installed as a modular insert in the well casing below the BOP stack or the riser pipe leaving a BOP stack.

First Embodiment

Description

FIG. 1 is an elevated, sectional view that shows a typical riser pipe or well casing with a lower section 100 that extends downward into the well, and a section 100A that extends upward above a BBBOP 102. Pipe 100 is transporting fluids 104, indicated by dashed lines and comprising mainly oil and gas, upward from an oil well. Pipe section 100-100A can be the passageway in a conventional BOP stack mounted above a well head, or in the riser pipe above the BOP stack. Additional BOPs can be inserted in the casing above or below BBBOP 102. BBBOP 102 performs the same function as the blind ram BOP described above, i.e., it is used when the well has been drilled and producing oil and/or gas and a drill pipe is not present inside casing 100-100A.

The present embodiment comprises a housing or container 106, a foraminous baffle or plate 108, one or more ball dispensing mechanisms (BDMs) 110 and 112, each with a group of balls 114. Housing 106 has an outlet 192 with a valve 196. Valve 196 has a large throat so that when it is in an open condition, balls 114 can pass out through it unimpeded. In addition, valve 196 has a simple actuating handle 198 that can be grasped by the robotic hand of an ROV or a person when the BBBOP is used in shallow water or above ground. Outlet 192 allows balls 114 to be swept out of housing 106 by injection of mud fluid downward through casing 100A from the top in order to "reset" the BBBOP, that is, unplug baffle 108 and allow oil and/or gas to flow freely through baffle 108. Outlet 192 is more fully described below in connection with FIGS. 2 and 3.

All components comprising BBBOP 102 and its various fittings are preferably made of steel (either stainless or coated to prevent corrosion) and are of sufficient thickness and strength to withstand the high pressures that are encountered deep undersea and within well bores. The diameter of housing 106 is generally greater than that of casing 100 and ranges generally from 20 to 200 cm, although other sizes may be used. The remaining components shown in FIG. 1 scale accordingly.

Baffle

Baffle or plate 108 is circular and is securely held within housing 106. It can be welded in place, or inserted into a circumferential groove. Baffle 108 contains numerous holes 116 which allow fluids 104 to pass upward and downward through baffle 108 without significant restriction or pressure drop. Holes 116 are preferably tapered outward at the bottom side and sized so as to admit and gently capture balls 114, but not allow them to pass through holes 116.

The present embodiment is for use during the production of oil and gas. Thus the casing does not contain a drill pipe and baffle 108 does not have a central hole for one. The aggregate area of holes 116 should be equal to or greater than the area of pipe 100 in order to ensure that baffle 108 does not interfere with flow in pipe 100. For example, a pipe 100 with a diameter of 28 cm has area equal to about 615 $cm^2$. If each hole 116 has a diameter of 5 cm, then the area per hole will be about 20 $cm^2$. Thus if there are 31 holes 116, they will have an aggregate area that is equal to the area of pipe 100. The diameter of baffle 108 is determined in part by the strength required to block the high pressures encountered during a blowout. If holes 116 are too closely spaced, baffle 108 will not have sufficient strength. Thus some solid area will be required between the holes. If baffle 108 has a diameter of 64 cm for an area of 3,215 $cm^2$ the area of solid metal will be 5 times that of the 31 holes 116, which should be sufficient. Because of the weight required at the well head, BOPs are generally much larger with typical diameters of 200 cm. Preferably the ratio of baffle area to hole area are used to select the diameter, thickness, and material strength required for baffle 108. The holes 116 in baffle 108 are sufficiently sparse compared to the total area of baffle 108 that no loose ball 114 that reaches the surface of baffle 108 will be trapped between balls already lodged in holes 116. Any loose ball has ample open surface on baffle 108 to move toward an open hole 116. Under high flow conditions, the fluid pressure is much less near open holes 116 where there is a large flow velocity increase compared to other surface areas on baffle 108. Hence, loose balls 114 move toward holes 116 that are open.

Ball Dispensing Mechanisms

BDMs 110 and 112 are part of BBBOP 102. BDM 110 is manually actuated, while BDM 112 is self-actuated. Although two are shown, additional BDMs of either type can be attached to BBBOP 102 for backup purposes. BDMs 110 and 112 are located beneath the level of baffle 108. Each holds a plurality of balls 114. In one embodiment balls 114 all have the same diameter, which is slightly greater than holes 116 in baffle 108. Balls 114 are typically made of metal such as stainless steel, although other materials can be used. They can be hollow or solid. If they are hollow, they must withstand extremely high blowout pressures in an oil well without collapsing. The density of balls 114 can be designed so that balls 114 will fall down casing 100 when they are not otherwise urged upward or contained by an additional baffle 250 (described below). In other applications, it may be desirable for balls 114 to float in any oil present below baffle 108. The ball density can be predetermined, as described below.

The number of balls 114 in each of BDMs 110 and 112 is greater than the number of holes 116 in baffle 108 so that there is high probability that all holes 116 in baffle 108 will be plugged by balls 114 when the flow of fluids or gas 104 is at a blowout rate. In the above example, baffle 108 contains 31 holes 116. For this case, BDMs 110 and 112 would each contain at least 40 balls.

BDM 110 has a simple and basic design for manual activation. It comprises a cylindrical tube 118 that is secured in a generally horizontal position to housing 106 at a position lower than baffle 108. Balls 114 can be released under baffle 108 from tube 118 by a hydraulic piston assembly described below. The interior of tube 118 that holds balls 114 opens into the region below baffle 108 via a spring-loaded trap door 120. An optional space is shown in tube 118 to the left (in front of) balls 114 to decrease the likelihood that the balls will fall out accidentally, i.e., the space insures that the balls have a lower probability of being expelled unless piston 122 is deliberately moved to the left.

In BDM 110, a plunger 122 is attached to the left end of a shaft 124. The right end of shaft 124 is attached to a piston 126 so that plunger 122, shaft 124, and piston 126 move together within tube 118. Shaft 124 and piston 126 are supported by O-ring seals 128 and 130, respectively. Seal 128 is supported at the central axis of tube 118 by a fixed support 132. A chamber 134A between support 132 and piston 126 contains a spring 134. Spring 134 urges piston 126 to its rightmost position, i.e., at which plunger 122 rests against support 132 within tube 118. A threaded cap 136 with an orifice 138 closes tube 118 at the right end, enclosing a hydraulic chamber 140 between the right end of piston 126 and the interior of cap 136. Chamber 134A has an exhaust port 134B with a one-way or check valve 134C so that any fluid or gas inside of chamber 134A can be expelled when piston 126 is urged toward support 132.

Dispensing Balls From BDM 110

At the upper right in FIG. 1, conduit 142 with shut-off valve 141 is connected to port 138. A one-way injection port 143 is also connected to chamber 140. When a blow-out condition occurs or the well operator otherwise desires to dispense balls 114 into BBBOP 102 from BDM 110, a small amount of pressurized fluid or gas is injected into chamber 140. The fluid or gas can be supplied through conduit 142 from a remote location such as a ship or platform (rig) or it can be supplied from an ROV (not shown) via one-way port 143. This fluid or gas enters chamber 140 and urges piston 126 to move forward, i.e., to the left, compressing spring 134. The force constant of spring 134 is selected to hold piston 126 back, i.e., to the right, until the fluid pressure in chamber 140 reaches a level sufficient to move rod 124 and plunger 122 to the left against the hydrostatic pressure inside casing 100. There is sufficient space in tube 118 so that balls 114 are not expelled out of tube 118 until spring 134 is compressed more than half way, as explained below in connection with BDM 112. When the pressure in chamber 140 fully compresses spring 134, plunger 122 has moved to the left and balls 114 are forced out through spring loaded trap door 120. Door 120 is held shut with sufficient spring force to prevent balls 114 from entering housing 106 until they are pushed out by plunger 122.

One ball 114A is illustrated in chamber 106 to show that when balls 114 are dispensed by BDM 110 into housing 106 under high, upward flow of oil or gas 104, they are forced upwardly toward holes 116 because the pressure is lower at the entrance to a hole than the pressure elsewhere in housing 106. Ball 114 will lodge in one of holes 116 in baffle 108 so long as there is significant flow of oil or gas.

When a plurality of balls 114 are released from below baffle 108 by BDM 110, the balls will be forced upwardly by the upward fluid flow, into the holes in baffle 108. The upward fluid flow will carry the balls upwardly to any holes that are open so that the balls will seal all of the open holes. Thus baffle 108 will become essentially completely obturating, thereby forming an effective blowout preventer and preventing any further upward fluid flow. I.e., the released balls 114 will plug holes 116 in baffle 106 to stop all fluid and gas flow through the baffle.

BDM 110 is a modular assembly that can be removed from housing 106 and reloaded with balls when necessary. This can be done easily by an ROV at great depths under water.

Dispensing Balls From BDM 112

The other ball dispensing mechanism 112 in FIG. 1 is self-actuating. It is actuated automatically when a predetermined pressure that represents a blowout condition occurs in casing or pipe 100. It can also be actuated manually at any time by additional apparatus shown in FIG. 1A.

BDM 112 comprises an inlet conduit 144, first and second tubular sections 146 and 148, respectively, a first fluid chamber 150, a second fluid chamber 151, a spring 152, and a piston-shaft-piston assembly 154, 156, and 158, respectively. O-ring seals 160 and 162 on piston 154 and plunger 162 separate chamber 150 from chamber 151 and the upper portion of tubular section 148, preventing fluid flow between the two chambers. Conduit 144 is preferably secured to casing pipe 100 by a sealed joint 164 and tubular section 148 is preferably secured to the bottom of housing 106 by a sealed joint 166. As with BDM 110, a spring-loaded trap door 168 retains balls 114 in place until they are pushed out by piston 158. The space above balls 114 in tube 148 is more important in BDM 112 because any increase in pressure P104 will compress spring 152. However the balls should not be expelled (i.e., baffle 108 should not be plugged by the balls) until P104 reaches the threshold pressure that will compress the spring at least half way and cause further increase in well pressure P104, etc.

Assembly 112 is connected to casing or pipe 100 by conduit 144 which allows pressurized oil and/or gas to reach piston 154 and apply hydraulic force to piston 154. Because of seals 160 and 162, fluid chamber 151 between pistons 154 and 158 is not subjected to the instant oil and/or gas pressure P104 in casing 100. However, oil or gas 104 from casing 100 can slowly leak by these seals into chamber 151. Vent conduit 172 connected to chamber 151 keeps the pressure in chamber 151 equal to pressure P300 of the environment outside BDM 112.

The outsides of pistons 154 and 158 are subjected to the same oil and/or gas pressure P104 that is present in casing 100. The inside surfaces of pistons 154 and 158 facing chamber 151 are subjected to the pressure in chamber 151. Vent conduit 172 keeps the pressure inside of chamber 151 the same as P300, the ambient pressure outside of BDM 112 and well casing 100. Hence, the net hydraulic force F154 on piston assembly 154-158 is determined by the difference between pressures P104 and P300 and the difference in the surface areas of pistons 154 and 158. The surface area of piston 154 is greater than that of piston 158, as shown. The cylinder for smaller piston 158 is narrower than that for piston 154. The junction between these cylinders comprises a shoulder that retains spring 152. When pressure P104 is greater than P300, the net hydraulic force F154 is always upward as shown in FIG. 1.

Connected pistons 154 and 158 are restrained from moving upward by spring 152. Spring 152 resists the net hydraulic force F154. Pistons 154 and 158 and spring 152 are designed such that spring 152 is fully compressed when the well casing 100 pressure P104 reaches a preset threshold pressure, Pt, that indicates a dangerous or blow out condition. Spring 152 will be compressed to some degree by any net force F154. Spring 152 will be compressed 50% when well casing pressure P104 reaches some level less than but close to the threshold pressure Pt. Tubular chamber 148 has sufficient empty space such that balls 114 therein are not expelled until spring 152 is compressed more than 50 percent. For each installation of BDM 112, spring 152 is designed such that it is at least 50% compressed when well pressure P104 approaches the threshold pressure Pt which indicates a blow out or dangerous condition for which the flow of oil and gas must be stopped in casing 100A.

The dynamic of how BDM 112 operates is as follows: Spring 152 is fully compressed when well casing pressure P104 reaches a predetermined threshold "blow out" pressure Pt. At some pressure P104 approaching Pt, spring 152 is compressed more than 50% and some balls 114 are expelled. The first balls 114 released will partially close baffle 108. Under blow out conditions (high fluid flow upward), pressure P104 will increase rapidly due to restricted flow in casing 100. This increase in P104 will fully compress spring 152 and force all balls 114 to be expelled by BMD 112. Balls 114 then completely block baffle 108.

When chamber 151 is full of incompressible fluid, the time required for release of balls 114 will normally be dictated by the time it takes to expel the fluid out through vent 172. Vent 172 can be sized such that very short transient P104 pressure increases that are not dangerous by themselves (spikes) will not expel balls 114. When BDM is above ground and chamber 151 is full of air at low pressure, the finite compression time of spring 152 allows BDM 112 to experience transient pressure increases or "spikes" of very short duration without releasing balls 114.

Another very important feature of BDM 112 is that vent 172 keeps the pressure in chamber 151 constant, equal to the outside ambient pressure P300. P300 is known for any given location where a BBBOP 102 with BDM 112 is installed (above ground or at a known depth underwater). Hence, BDM 112 with vent 172 can be designed to activate and expel balls 114 at a fixed blowout threshold pressure P104.

The use of vent 172 or its equivalent for equalizing pressure in chamber 151 is important because over a long period of time in the hostile environment of an oil or gas well, particularly underwater, seals 160 and 162 around pistons 154 and 158 will begin to leak, at least slowly. Oil or gas 104 will infiltrate chamber 151. Without vent 172, the net force F154 generated by a given pressure P104 will vary depending on the contents of chamber 151. If a closed chamber 151 is filled with incompressible fluid, for instance, then BDM 112 becomes completely inoperable at any blowout pressure P104 since piston 154 cannot move forward. If a closed chamber 151 is filled with gas, then the net force F154 for a given threshold pressure P104 will vary depending on how much gas has leaked out (or into) chamber 151 due to "leaky" seals 160 and 162. Neither of these conditions, unknown pressures from varying amounts of fluid or gas in chamber 151, allows BDM 112 to be adjusted or set to activate properly for a fixed blowout threshold pressure. However, with vent 172 and a constant known pressure P300 inside chamber 151, BDM 112 can be designed or set to release balls 114 at a fixed blowout threshold pressure Pt in well casing 100. Thus it is not necessary to maintain or adjust BDM 112 to account for deterioration of the seals 160 and 162 and slow leakage of oil or gas into chamber 151 since vent 172 keeps the hydraulic pressure in chamber 151 at the ambient outside pressure P300 at all times.

FIG. 1A

Alternative Embodiments with Activation Threshold Adjustment—BDM 112

Figure 1A:
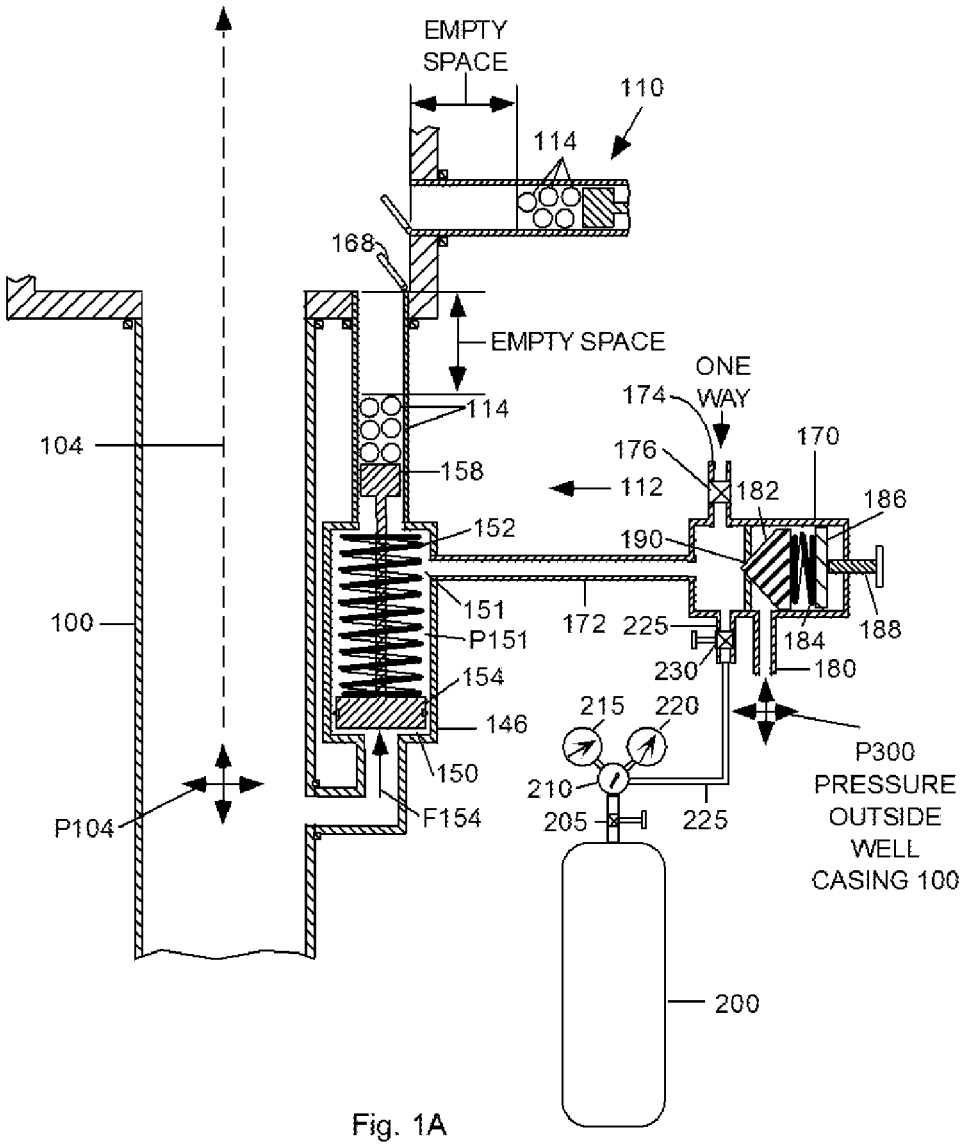
FIG. 1A shows the embodiment of FIG. 1 with a pressure threshold adjustment mechanism.

FIG. 1A shows an alternative embodiment of BDM 112 in which the predetermined blowout threshold pressure P104 for release of balls 114 can be adjusted after BDM 112 is installed, including manual adjustment and adjustment by ROVs operating deep underwater. Two blowout threshold pressure adjustment modalities are shown. The first uses an incompressible fluid and the second uses a compressible gas. Both modalities are shown in FIG. 1A for convenience and their use can be combined; however preferably only one or the other of them is used at any one time.

FIG. 1A

Activation Threshold Adjustment by an Incompressible Fluid

As described above in connection with FIG. 1, changing the fluid or gas pressure in chamber 151 changes the net force F154 produced by a given well casing pressure P104. The pressure in chamber 151 can be varied by filling chamber 151 with either liquid or gas. Consequently, the threshold pressure P104 in well casing 100 that activates BDM 112 can be changed by changing the pressure in chamber 151. The small amount of liquid or gas injected into chamber 151 via inlet 174 or from source 200 can be precisely controlled by a conduit from a remote location or by an ROV operating deep underwater.

In FIG. 1A, an additional valve 170 is connected to chamber 151 of BDM 112 via conduit 172. Valve 170 is an adjustable pressure relief valve comprising a stopper 182, a spring 184, a plate 186 that is urged against spring 184 by a screw 188, and an orifice 190. An inlet 174 with a one-way check valve 176, also connected to chamber 151 via conduit, allows the injection of pressurized fluid through inlet 174 into chamber 151 in the same manner that pressurized fluid is injected into BDM 110 through injection port 138, as described above. The release pressure at which pressure release valve 170 opens is adjusted by turning an adjustment screw 188 that controls the compression force of spring 184 on pressure release valve stopper 182.

When chamber 151 is filled with incompressible fluid via inlet 174, piston 154 can only move forward when the fluid pressure in chamber 151 forces open relief valve 170. Hence, changes in the release pressure setting of valve 170 change threshold blowout pressure P104 (Pt) that activates BDM 112. When chamber 151 is filled with an incompressible fluid, spring 152 is not compressed by transient increases in pressure P104 that are less than necessary to open relief valve 170. Spring 152 can only be compressed when P104 is high enough to force open relief valve 170. Thus, the setting of relief valve 170 determines the threshold pressure at which BDM 112 is activated. Normally, the Pt "blow out" threshold pressure setting (determined by the setting of valve 170) will result in complete compression of spring 152. Thus in a blowout condition BDM 112 activates suddenly and completely to expel all balls 114. In this case, spring 152 acts only as a "cushion" to slow the speed at which piston 154 moves forward in a time equal to the full compression time of spring 152.

FIG. 1A

Activation Threshold Adjustment by a Gas

In an alternative aspect of the present embodiment, a tank 200 provides gas at a predetermined pressure in chamber 151 in order to allow adjustment of the effective blowout threshold pressure at which BDM is activated. Using gas instead of an incompressible fluid causes BDM 112 to activate in a more gradual fashion than with fluid in chamber 151.

Tank 200 contains a pressurized gas such as nitrogen that can be delivered to chamber 151 through conduit 172. Tank 200 has a shut-off valve 205, a regulating valve 210, and two pressure gauges 215 and 220. The outlet of regulating valve 210 is connected to conduit 172 via a port 225 and a valve 230. Valves 205, 210, and 230 all have simple adjustment handles that are suitable for operation by the robotic hand of an ROV. Regulator 210 ensures that the pressure inside chamber 151 remains at a predetermined level for an extended period of time. This is desirable since seals such as 160 and 162 and valve 170 can leak over time.

The gas pressure in chamber 151 at any time contributes to the downward force on piston 154 and therefore determines the force necessary to move piston 154 upward. A compressible gas in chamber 151 provides a "cushion" against forward movement of piston 154 and provides a time delay so that balls 114 will not be immediately released into housing 106 when high blowout pressure P104 forces piston 154 forward. The gas pressure in chamber 151 can be adjusted in conjunction with relief valve 170 to dictate the threshold pressure on piston 154 that is required to move piston 154 forward and release balls 114. The gas pressure in tank 200 must be greater than the normal well head pressure P104 in well casing pipe 100 in order to prevent incompressible fluid from the well from leaking past seals 160 and 162 and filling chamber 151. For a well that is 1.5 km (5,000 ft) under water, the pressure required in tank 200 can be as high as 345 bars (5,000 psi). It will be much lower for a surface well head with normal oil and gas pressure.

Attaching tank 200 to BDM 112 provides an alternative way to maintain a constant pressure in chamber 151 so that a constant blowout threshold pressure Pt setting can be maintained for BDM 112. Tank 200 eliminates the need for an open vent 172 as in FIG. 1 that communicates with the outside pressure P300. An open vent 172 can be clogged with debris in dirty environments. Normally, the pressure of the gas maintained in chamber 151 by tank 200 will be greater than the average well casing pressure P104. With this pressure difference there will be little or no leakage of fluid from well casing 100 past the seals 160 and 162 into chamber 151.

Both threshold pressure adjustment modalities 170 and 200 for BDM 112 are shown in FIG. 1A for convenience and their use can be combined. However, preferably only one or the other of them is used at any one time.

BDM 112 is a modular assembly that can be removed from housing 106 and reloaded with balls when necessary. This exchange of BDMs 112 can be done easily by an ROV at great depths underwater. Several BDMs 112 can be mounted on a BBBOP casing 106 for backup and redundancy.

In addition to being able to dispense balls when a predetermined pressure P104 is reached, BDM 112 also provides a very reliable, robust general-purpose threshold pressure detector that can be used for many additional purposes. E.g., when piston 158 moves up in response to a pressure threshold being exceeded at P104, it will move upward a predetermined distance. This movement can be used to generate an increased pressure in conduit 148, creating a pressure signal which can be sensed to cause an electromagnetic signal to be transmitted, any mechanical device to be actuated, etc. BDM 112 is purely mechanical and does not require or use any electronic components. It can survive long periods in hostile, high-pressure environments such as an oil well, because its seals can leak slowly, as described, without harming its operation, even if the pressure outside suddenly exceeds a threshold.

While BDM 112 has upper and lower ports that are connected to the lower end of chamber 106 and a point in casing 100 below chamber 106, these two ports can be connected at alternative locations, such as upper and lower apertures on chamber.

Alternative Embodiment

Figure 2:
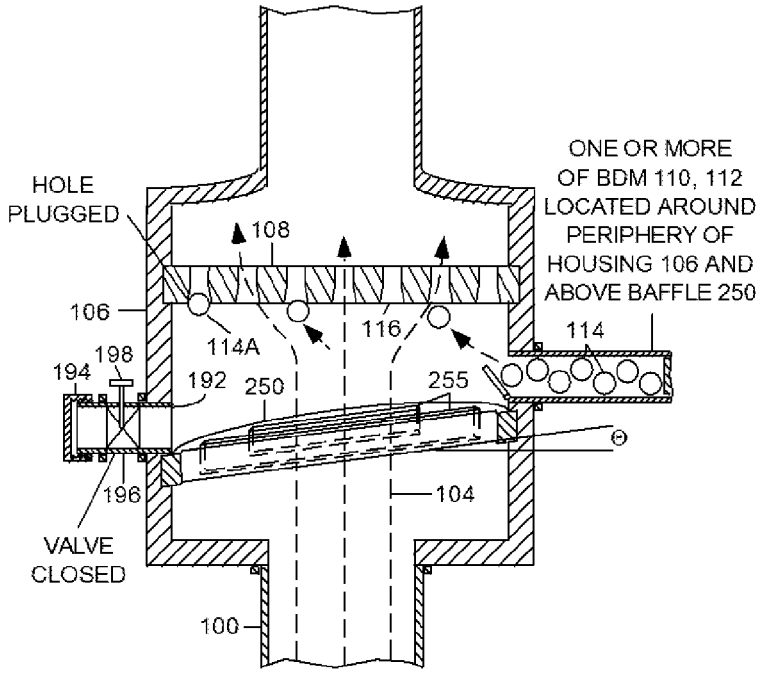
FIG. 2 shows the embodiment of FIG. 1 with a second baffle upon activation.
Figure 3:
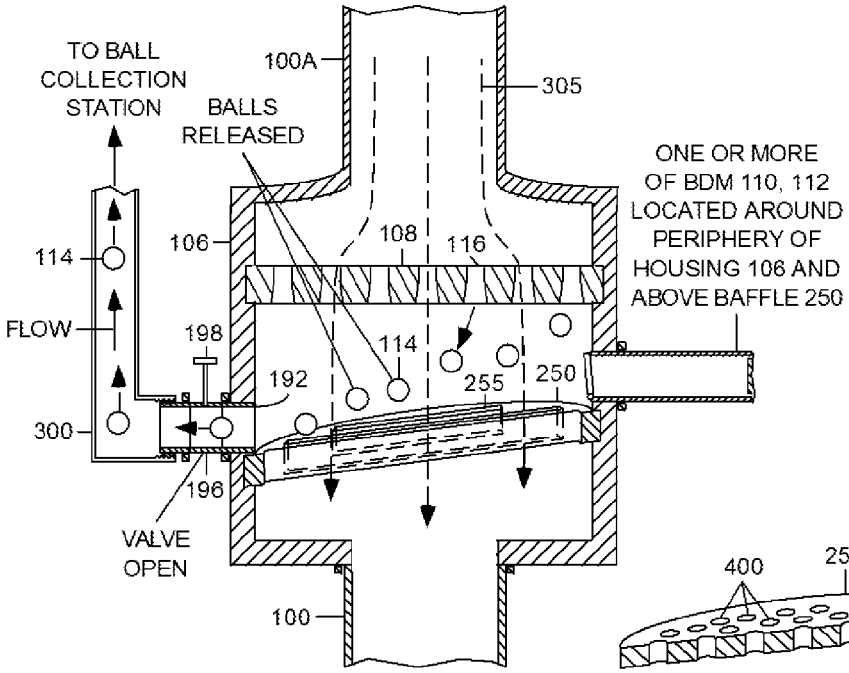
FIG. 3 shows embodiment of FIG. 2 upon deactivation.
Figure 4:
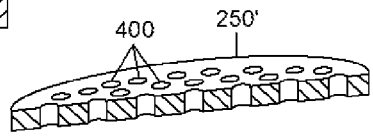
FIG. 4 shows an alternative baffle for the embodiments of FIGS. 1-3.

FIGS. 2-4—Description and Operation

Figure 2A:
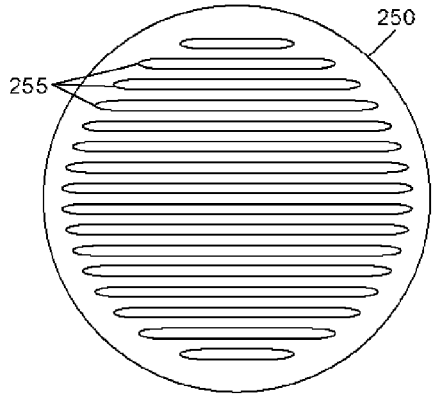
FIG. 2A shows a plan view of a slotted baffle.

FIGS. 2 and 3 are sectional, side views of a first alternative embodiment in which a second baffle 250 is rigidly secured below baffle 108 to prevent balls 114 from falling down well casing 100 when they are not urged against holes 116 in baffle 108 by high velocity upward flow of oil or gas. Thus balls 114 are normally captured within the volume between baffles 108 and 250. In FIG. 2, baffle 250 preferably contains a plurality of slots 255 as shown in FIGS. 2A and 3. The combined area of slots 255 is greater than the combined area of holes 116 so that flow through baffles 108 and 250 is not impeded so that downward flow of mud fluid, when necessary, can continue even when balls 114 are resting on baffle or plate 250. The width of slots 255 is less than the diameter of balls 114 so that balls 114 are unable to pass through or lodge within slots 255. Baffle 250 is tilted at an angle, θ, e.g., 15 degrees and preferably between 0 and 30 degrees. In FIG. 3, balls 114 will be urged down to baffle 250 and toward outlet 192 when pressurized mud fluid is forced down well pipe 100A and through baffle 108 and baffle 250.

When it is desired to unblock baffle 108, balls 114 are removed from housing 106 as shown in FIG. 3. A conduit 300 is affixed to outlet 192 in place of cap 194 (FIG. 2). Fluid, such as a mixture of water and drilling mud, is pumped into pipe 100A from above as indicated at 305. The pressure at which the fluid is pumped downward is greater than that of the fluid that is urged to flow upward in casing 100 (a normal "top kill" well control procedure). Thus a net downward flow of fluid occurs, urging balls 114 to fall downward out of holes 116 toward baffle 250. At this time, valve 196 is opened and the fluid flow indicated at 305 exits housing 106 via outlet 192, valve 196, and conduit 300. Balls 114 are entrained in this flow and are thus removed from chamber 106. The slope of baffle 250 aides in urging balls 114 toward outlet 192.

In an alternative aspect, conduit 300 can be omitted and balls 114 can be discarded outside housing 106 if desired.

Outlet 192 is equivalent to the standard "mud" or "choke" ports on existing BOP stacks that are used to inject and extract fluids from the well at the BOP stacks. There may be additional mud and or choke ports positioned on housing 106 between baffle 108 and baffle 250 for the purpose of recirculating mud fluid and/or pressure testing the integrity of the BBBOP assembly in the same standard fashion that conventional BOPs are pressure tested.

FIG. 4 shows an alternative baffle 250' that contains holes 400 instead of slots 255 (FIGS. 2 and 3).

FIG. 5

Alternative Aspect—Passive, Fail-Safe BBBOP for Capped Wells

Figure 5:
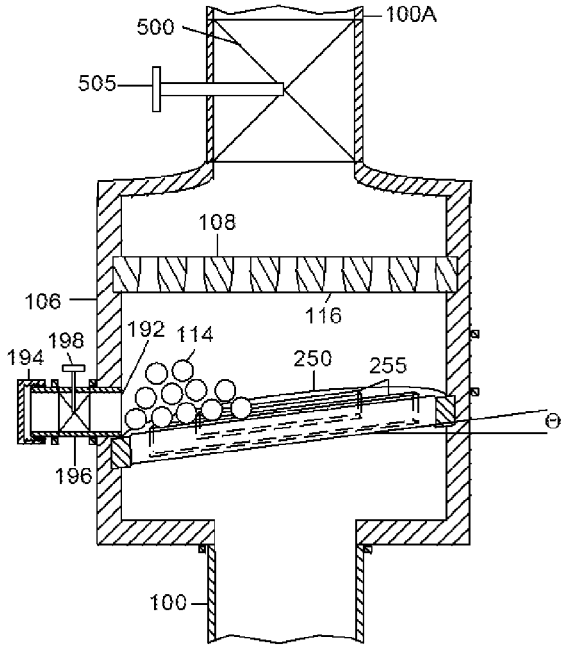
FIG. 5 shows yet another alternative aspect of the embodiment of FIGS. 1-3.

FIG. 5 shows an alternative aspect of the first alternative embodiment. This embodiment provides a passive, fail-safe BBBOP or shut off valve for thousands of abandoned wells that have been capped with concrete plugs in their well casings. Expensive BOP stacks have been removed from most capped wells. But these "dead" wells may come alive again someday and leak when their concrete plugs and steel well casings deteriorate. The "capped well" BBBOP embodiment in FIG. 5 provides an inexpensive means to prevent serious leakage from capped wells, in particular underwater wells that have been capped and abandoned.

In FIG. 5, instead of injecting balls 114 via BDMs 110 or 112 during a blowout as in FIG. 1, a plurality of balls 114 are simply left in chamber 106 where they remain between baffle 108 and baffle 250. The density of balls 114 is designed such that any substantial upward flow of oil or gas will cause balls 114 to plug the holes 116 in baffle 108. Balls 114 can be designed (as described in FIG. 9 below) such that they normally float in water or oil so that only a slight upward flow force on the balls will cause them to plug holes 116 in baffle 108. Hence, the BBBOP embodiment of FIG. 5 is a passive one-way valve that allows sea water or other fluids to enter well casing or riser pipe 100A or port 192 at all times but stops any substantial upward flow of oil or gas. When balls 114 rest on slots 255 in baffle 250, they do not occlude the slots. Therefore fluid can flow freely downward through the spaces in baffle 250 when balls 114 are present.

A valve 500 is inserted into riser pipe 100A and closed by turning an actuator 505. Actuator 505 is sized and shaped so that it can be operated by the robotic hand of an ROV (not shown). Valve 500 is normally open at all times to allow free flow of liquids down pipe 100A. Valve 500 can be used to close pipe 100A when there is no great pressure against the valve. Valve 500 can be closed to stop slow leakage from the well that does not actuate the BBBOP of FIG. 5 or when the well is being reworked through port 192 with no great upward pressure at the well head.

The one-way valve BBBOP embodiment of FIG. 5 allows free flow of sea water down pipe 100A at all times for underwater wells that have been capped and abandoned. A sea water column in the well casing provides pressure atop the concrete plugs to counteract the pressure of oil and gas forcing the plugs upward. The well casing at the top of underwater plugged wells is normally open for this reason. This is done to maintain a column of sea water above the concrete plugs in the well casing. If the well is closed at the top, the essential sea water column in the well casing can dissipate over time.

Outlet 192 is normally kept closed by a cap 194 for this "capped well" BBBOP. It can be opened and used in case rework of the well is necessary or desired in the future by injecting mud fluid down the well to control it, that is, stop the upward flow of oil or gas. In this and the other embodiments of the BBBOP, outlet 192 can be used for purposes other than purging balls 114 from housing 106, such as servicing the well. For example, cap 194 can be removed and a conduit (not shown) containing mud fluid can be attached. When valve 196 is opened, the mud fluid can be forced into the well. In this case, port 192 becomes a standard "mud port" as found on standard BOP stacks.

The capped well BBBOP will normally be encased in a very heavy block of steel or concrete similar to the weight of the standard steel BOP stack that was in place during drilling and production of the well. This heavy encasement is necessary to counteract the substantial upward hydraulic force at the well head exerted by a blowout that bypasses the concrete plugs and pushes out the sea water column above them. The blowout upward force can be of the order of 0.9 meganewton (100 tons). Hence, the encasement around the BBBOP must be even heavier. This capped well BBBOP would normally be encased in a heavy concrete block sitting on top of the well head instead of much more expensive steel as is used for standard BOP stacks.

Second Alternative Embodiment

Figure 6:
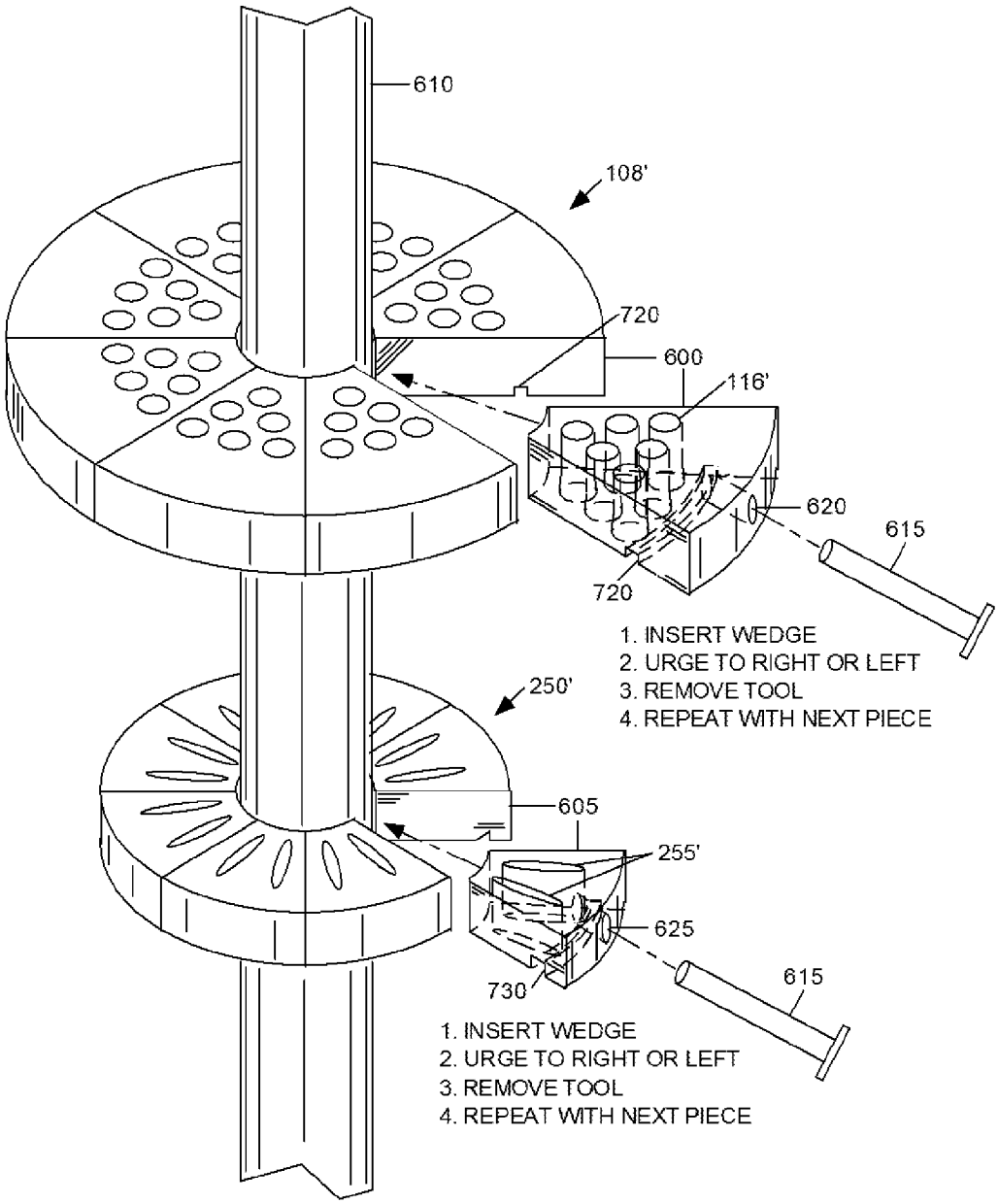
FIGS. 6 through 8 show an alternative embodiment.
Figure 7:
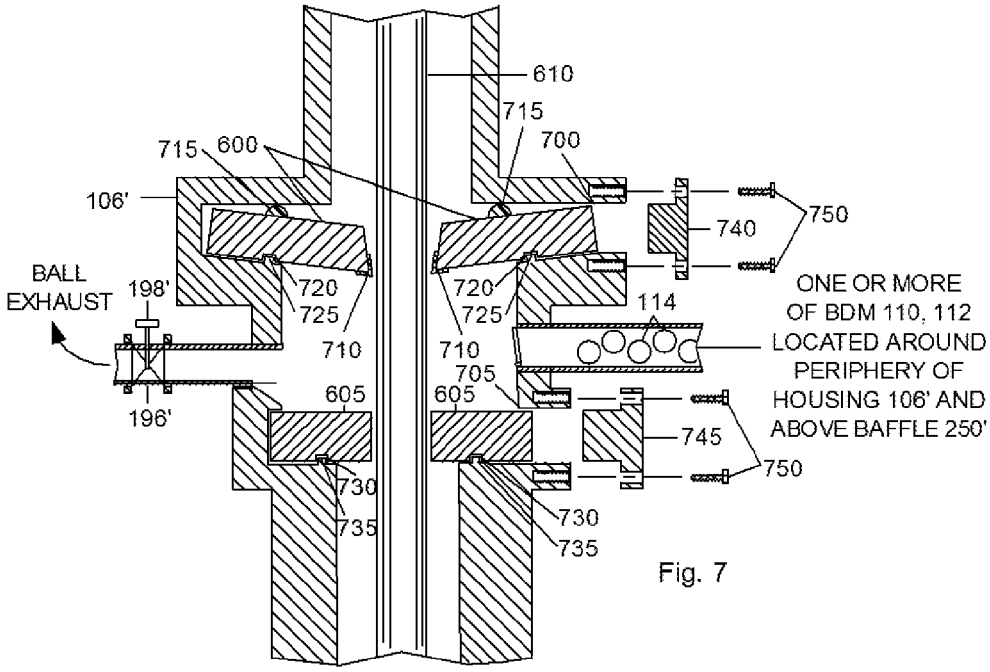

FIGS. 6-7—Changeable Baffles—Description

Figure 8:
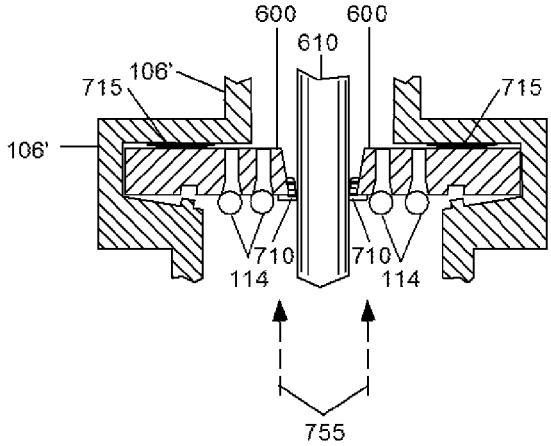

The previous BBBOP embodiments are designed to prevent blowouts of producing or capped wells from which the drill pipe or other production pipes have been removed. FIGS. 6 through 8 show an embodiment of the BBBOP that accommodates drill pipes of various predetermined diameters inside well casing 100, FIG. 1, and internal pipes in casing 106' in FIGS. 7 and 8. This embodiment accommodates drill pipes of various predetermined diameters by adjusting the central hole size of the baffles to fit the drill pipe diameter so that a tight seal can be obtained during a blowout. A first drill pipe having one diameter can be withdrawn and replaced with another one having a different diameter.

FIG. 6 is a perspective view showing upper and lower baffles 108' and 250', respectively, which are assembled from a plurality of wedge-shaped pieces 600 and 605 that are arranged to surround a drill pipe 610. Housing 106' has been omitted from this figure for clarity. Wedges 600 include a plurality of holes 116 that are sized and shaped to accept and be obturated by balls 114, as above. Wedges 605 include a plurality of slots 255' that are sized as in the previous embodiments to permit flow of fluids while preventing balls 114 from falling down into the well.

One or more tools 615 are shaped for easy grasping by the robotic hand of an ROV. In use, tool 615 is slidably inserted into a mating hole 620 or 625 in respective wedges 600 and 605. Wedges 600 and 605 are then inserted into BBBOP housing 106' through removable ports 700 and 705 (FIG. 7), respectively. Ports 700 and 705 are slightly wider than the outer edge of wedges 600 and 605. Once wedges 600 and 605 are inserted into ports 700 and 705, tool 615 is used to push the wedges to the right or the left in order to make room for the tip of the next wedge to be inserted. When the tip of the next wedge is forced inward, it will cam all wedges presently inside housing 106' to the right and/or to the left in order to make room for this next wedge. When insertion of this next wedge is completed and the rest of the previously inserted wedges are pushed around as far as possible, tool 615 is removed and used to insert another wedge. Additional wedges 600 and 605 are inserted and pushed around until baffles 108' and 250' are complete.

FIG. 7 is a cross-sectional, side view of a BBBOP according to one aspect of the present embodiment. Wedges 600 and 605 have been inserted through ports 700 and 705. Wedges 600 are preferably nominally trapezoidal when seen from above and from the side and include an elastomeric seal 710 at the lower end near pipe 610. An elastomeric bumper 715 is secured to the top of each of wedges 600. These bumpers compress and lie flat during insertion of wedges 600 through port 700. Once wedges 600 are in place, bumpers 715 expand to their original shape and bear against the upper, inner wall of housing 106', preventing wedges 600 from vibrating under varying pressures in the well. During normal use, wedges 600 are tilted downward near pipe 610 to provide an open area for the flow of oil and to avoid wear due to contact with pipe 610. During a blowout, balls 114 block holes 116' and wedges 600 are forced upward, pressing seal 710 tightly against pipe 610 (FIG. 8) and stopping the flow of oil and gas.

The underside of each of upper set of wedges 600 includes a curved, recessed slot 720 that mates with a raised ring 725 in housing 106'. Regions 720 on each of wedges 600 seat on ring 725 so that wedges 600 are normally held out of contact with pipe 610. Similarly lower set of wedges 605 include a curved, recessed slot 730 that mates with a raised ring 735 around the lower, inner surface of housing 106'. Wedges 705 are held away from pipe 610 at all times.

After all of wedges 600 and 605 are in place, plugs 740 and 745 are slidably inserted into ports 700 and 705 and bolted in place by bolts 750. As with other movable parts, the heads of bolts 750 are shaped for easy rotation by the robotic hands of an ROV.

FIG. 8

Operation Of Second Alternative Embodiment

FIG. 8 is a cross-sectional view of a portion of housing 106' of the present embodiment during prevention of a blowout. Increased pressure and flow from the well, indicated by dashed arrows 755, has caused balls 114 to rise within housing 106' and block holes 116' in upper baffle wedges 600. Balls 114 were either (a) dispensed automatically by BDM 112, (b) could have been left in the space between baffles 108' and 250' to be deployed automatically, or (c) dispensed manually by BDM 110.

Wedges 600 have been forced upward by the well pressure, pivoting around the outer edge adjacent the inner surface of housing 106' and moving from a downward slanted position to horizontal. The upward pressure has compressed bumpers 715, causing them to spread out and form a seal between wedges 600 and housing 106'. With wedges 600 in this position, elastomeric seals 710 impinge tightly against pipe 610, completing the sealing of the well.

When it is desired to remove or replace pipe 610 with another of a different size, ports 700 and 705 are opened and wedges 600 and 605 are first removed. Then pipe 610 is replaced, and finally a new set of wedges 600' and 605' (not shown) properly sized for the new pipe (not shown) are inserted. Finally ports 700 and 705 are again closed by plugs 740 and 745.

FIG. 9

Ball for Use in all Embodiments

Figure 9:
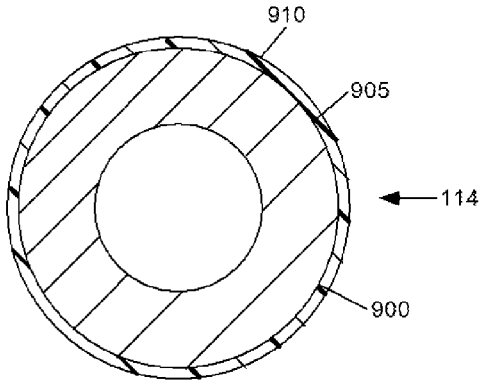
FIG. 9 shows a ball for use in all embodiments.

FIG. 9 shows a cross-sectional view of one composite version of ball 114 that may be used in the various embodiments of the BBBOP described above. Ball 114 comprises a core 900, a shell 905, and an outer surface 910.

Core—The material comprising core 900 is used in part to determine the density of ball 114. If core 900 is absent, the density of ball 114 is low and is determined by the density and thickness of shell 905 in combination with surface material 910. Core 900 can be solid material of any sort or it can be filled with a high-pressure gas or an incompressible fluid to resist crushing of ball 114 when it wedges in a hole 116 of baffle 108 (FIG. 1).

Shell—Shell 905 is made of a hard material such as a strong metal, ceramic, or plastic. This is necessary to prevent the collapse or distortion of ball 114 when it is in use.

Surface—The outer surface 910 of ball 114 comprises a thin sealant layer of elastomeric material. When ball 114 is forced into hole 116, surface 910 conforms to any irregularities in the surface of the entrance to hole 116, thereby preventing any upward leaks of oil or gas.

Strong balls 114 that will not be crushed in the holes 116 of a BBBOP can be designed to have densities more or less than oil or any other fluid by selection of the appropriate core, shell and surface materials.

CONCLUSIONS, RAMIFICATIONS, SCOPE

I have provided a Ball Baffle Blowout Protector (BBBOP) for oil and gas wells and a shut-off valve for high pressure pipelines that, in one or more embodiments, can be actuated more reliably, is less likely to fail, is a simple, fail-safe system, requires no great mechanical or hydraulic force to operate properly, and is self-actuated when well pressures exceed specified limits that indicate a possible blowout. The pressure threshold is easily adjusted by remote control and can be activated by an ROV deep underwater. The BBBOP can seal a well in a non-destructive manner and can be opened (reversed) to allow normal well operation. The BBBOP is easily added to the top of existing and conventional BOP Stacks to provide the added measure of safety for deep underwater wells that the world hopes can be achieved. One embodiment provides an extremely important, inexpensive, fail-safe BOP (shut off valve) for thousands of capped wells that will leak or blowout someday when their concrete plugs and steel well casings deteriorate.

The embodiments described are so inexpensive that multiple Ball Baffle BOPs (BBBOP) can be stacked on top of one-another as is presently done with conventional shear-ram BOPs. Each BBBOP in a stack can operate independently of the others, with no interference from one to another. When multiple BBBOPs are stacked, each can be set to self-actuate at a different well bore pressure if desired by adjusting the threshold ball release pressure of BDM 112. Alternatively, an ROV can manually activate any of the BBBOPs using BDM 110. The "blowout" pressure detection apparatus in the self-activating BBBOP is immune to inevitable fluid and gas leaking by its hydraulic seals.

While the above description contains many specificities, these should not be construed as limitations on the scope, but as exemplifications of some present embodiments. Many other ramifications and variations are possible within the teachings of the invention. For example, the material of the balls can be changed, the balls can be made of a solid metal or a composite as illustrated in FIG. 9, or can have a hollow core. The balls can be made of a hard metal or a soft metal or other material so as to conformingly mate with the any irregular holes in the baffle. The activating mechanisms can be varied, as can the shapes of the components. The BBBOP can be used with gas, oil, or combined wells, either underwater or on land. The holes in the baffle and the diameters of the balls can be non-uniform in size. The holes in the baffle can be made non-circular in order to permit a partial seal that would release pressure while slowing flow. The sizes and shapes and materials of all components can be varied. The BBBOP can be used as a general purpose shutoff valve. For example, it can economically replace standard ball or gate valves in very large water or gas pipes. It can be operated manually or automatically to control flow in pipes of any sort that carry fluids. While the embodiments with two baffles are described for use in blocking upward fluid flow, they can also be used to block fluid flow in the downward direction or either horizontal direction if the conduit is horizontally oriented. To block flow in either of two directions, the lower or second baffle should be provided with holes (like the upper baffle) that can be obturated with balls. By injecting or providing a plurality of balls between the baffles, the fluid flow will carry them to the downstream baffle, where they will mate in respective holes and cause that baffle to become obturating. In lieu of a spring-loaded trap door to hold balls 114 in tube 118 (FIG. 1) any other type of openable ball retainer, such as a friable barrier, can be provided.

Thus the full scope should be determined not by the specifics given but by the appended claims and their legal equivalents.

The invention claimed is:

1. A shut-off valve for use on a pipe or conduit that has a predetermined cross-sectional area and that carries a high-pressure fluid or gas, comprising:

a chamber having input and output ports that can be connected in series with said high-pressure fluid or gas pipe or conduit, a baffle or plate mounted in said chamber between said input and output ports, said baffle having a plurality of holes therein for normally allowing fluid or gas to pass through said chamber from said input port to said output port, said baffle having upstream and downstream surfaces, said plurality of holes in said baffle or plate having an aggregate area at least as large as said predetermined cross-sectional area of said pipe or conduit so that said baffle or plate will not significantly restrict fluid or gas flow through said pipe or conduit when said holes are not obturated, a plurality of obturating balls positioned so that they can be released in said chamber upstream of said baffle, said balls having a predetermined density so that a predetermined fluid or gas flow from said input port to said output port will carry said balls up against said upstream surface of said baffle, said balls having a size larger than said holes so that when said balls are carried against said upstream surface of said baffle they will be lodged in respective holes of said baffle so as to obturate said holes of said baffle and prevent fluid or gas flow through said baffle from said input port to said output port.

2. The valve of claim 1, further including a ball dispenser outside said chamber and arranged to hold and release said balls into said chamber in response to a predetermined activation.

3. The valve of claim 2 wherein said predetermined activation is an activation from a remote location.

4. The valve of claim 3 wherein said ball dispenser comprises a cylinder having one end connected to said chamber via an openable ball retainer and a second, opposite end connected to a conduit arranged to supply a pressurized fluid or gas, said cylinder containing said balls adjacent said one end, said cylinder containing a pair of pistons connected by a rod, a first piston being adjacent said balls, a second piston being adjacent said second end, a stop block between said pistons, a spring having two ends with one end adjacent said second piston and a second end adjacent said stop, whereby pressure applied to said second piston via said conduit will force said second piston and hence said first piston toward said chamber against said spring and force said balls into said chamber.

5. The valve of claim 2 wherein said predetermined activation is a predetermined fluid or gas pressure.

6. The valve of claim 5 wherein said ball dispenser comprises:

a cylinder having two ends, one end connected to said chamber or to a fluid or gas pipe that is connected to said input port of said chamber via a openable ball retainer and a second, opposite end connectable to a more upstream part of said chamber than said one end or to a more upstream part of said fluid or gas pipe that that is connected to said input port of said chamber, said cylinder containing said balls adjacent said one end, said cylinder containing a pair of pistons connected by a rod, a first piston being adjacent said balls and having a relatively small area, a second piston being adjacent said second end and having a relatively large area, an area between said pistons being connected to a volume outside said cylinder by a side port, a stop or shoulder between said pistons, a spring having two ends with one end adjacent said second piston and a second end adjacent said stop or shoulder, whereby a predetermined pressure in said chamber or said fluid or gas pipe that is connected to said lower port of said chamber will force said second piston and hence said first piston toward said chamber against said spring and force said balls into said chamber.

7. The valve of claim 6 wherein said side port connects said cylinder to an ambient volume around said cylinder.

8. The valve of claim 6, further including a relief chamber containing a relief valve, said side port being connected to said relief chamber, said relief valve arranged to connect said side port to said ambient volume in response to a predetermined pressure in said cylinder.

9. The valve of claim 6 wherein said side port connects said cylinder, via a valve, to a container filled with a pressurized gas.

10. The valve of claim 1, further including a second baffle or plate mounted in said chamber between said input and output ports, said second baffle having a plurality of holes therein for normally allowing fluid or gas to pass through said chamber from said input port to said output port, said balls being positioned so that they can be released into said chamber between said first-named baffle and said second baffle, said balls being larger than said holes in said second baffle.

11. The valve of claim 10 wherein said chamber has an axis and said second baffle is mounted at an angle to said axis so that said second baffle has a lower end and an upper end, said chamber having a valved outlet adjacent said lower end of said second baffle so that balls resting against said second baffle can be removed from said chamber via said outlet.

12. The valve of claim 11 wherein said holes in said second baffle are elongated so that said balls will not obturate said holes when they rest on said holes.

13. The valve of claim 1 wherein said baffle comprises a series of wedge-shaped sections that are shaped and can be combined to form a circular baffle having a center opening, said chamber having a port sized to enable said wedge-shaped sections to be removed from or inserted into said chamber by a remotely operated device, whereby said valve is especially useful for fluid or gas wells that contain a drilling column in said fluid or gas pipe.

14. The valve of claim 1, further including a second baffle mounted in said chamber between said input and output ports, said second baffle having a plurality of holes therein for normally allowing fluid or gas to pass through said chamber from said input port to said output port, said baffle comprising a series of wedge-shaped sections that are shaped and can be combined to form a circular baffle having a center opening, said chamber having a port sized to enable said wedge-shaped sections of said second baffle to be removed from or inserted into said chamber by a remotely operated device, whereby said valve is especially useful for fluid or gas wells that contain a drilling column in said fluid or gas pipe.

15. The valve of claim 14 wherein said chamber has an axis and the wedge sections of said first baffle are shaped and mounted at an angle to said axis so that said wedges of said first baffle do not contact said drilling column and allow fluid or gas to pass between the inner sides of said wedge sections and said drilling column but in response to a predetermined fluid or gas flow will be forced to a normal orientation to said axis to contact said drilling column to prevent fluid or gas from passing between the inner sides of said wedge sections and said drilling column.

16. The valve of claim 15 wherein said wedge sections contain resilient seals on a plurality of surfaces thereof for assisting in blocking fluid or gas from flowing past said wedge sections in said normal orientation.

17. A method for blocking fluid or gas flow in a conduit having a lumen with a predetermined cross-sectional area, comprising:

providing a baffle or plate extending across said lumen of said conduit, said baffle having a plurality of holes therein for normally allowing fluid or gas flow in said conduit to flow through said holes and pass through said baffle, said plurality of holes in said baffle having an aggregate area at least as large as said predetermined cross-sectional area of said lumen of said conduit so that said baffle will not significantly restrict fluid or gas flow through said pipe or conduit when said holes are not obturated, and providing a plurality of obturating balls in said conduit on one side of said baffle so that fluid or gas flow in said conduit in excess of a predetermined threshold flow rate will carry said balls up against one side of said baffle, said balls having a size larger than said holes so that when said fluid or gas carries said balls against said one side of said baffle, they will be lodged in respective holes of said baffle so as to cause said baffle to block fluid or gas flow in said conduit past said baffle.

18. The method of claim 17 wherein said plurality of obturating balls are provided from a ball-dispensing mechanism outside of said conduit by a method selected from the class consisting of automatically activating and manually activating said ball-dispensing mechanism.

19. A ball-dispensing mechanism for dispensing a quantity of balls in response to a predetermined pressure differential, comprising:

a cylinder having two ends, one end being connectable to a first port in a fluid or gas pipe or chamber via an openable ball retainer and a second, opposite end connectable to a second port of said fluid or gas pipe that is spaced from said one port, said cylinder containing a plurality of balls adjacent said one end, said cylinder containing a pair of pistons connected by a rod, a first piston being adjacent said balls and having a relatively small area, a second piston being adjacent said second end and having a relatively large area, a volume or chamber between said pistons being connected to a volume outside said cylinder by a side port, said cylinder having two parts, a relatively narrow part that contains said first piston and a relatively wide part that contains said second piston, a stop or shoulder between said pistons, a spring having two ends with one end adjacent said second piston and a second end adjacent said stop or shoulder, whereby a predetermined pressure in said fluid or gas pipe will force said second piston and hence said first piston toward said first port against said spring and activate said ball-dispensing mechanism to force said balls into said fluid or gas pipe.

20. The ball dispensing mechanism of claim 19, further including a relief chamber containing a relief valve, said side port being connected to said relief chamber, said relief valve arranged to connect said side port to said ambient volume in response to a predetermined pressure in said cylinder.

21. The ball dispensing mechanism of claim 19, further including means for controlling the pressure in said chamber between said pistons such that the hydraulic seals on said pistons can slowly leak the ambient fluid or gas pressure from said fluid or gas pipe without changing said predetermined pressure at which said ball dispensing mechanism is actuated.

* * * * *